US008807398B2

(12) United States Patent
Sundberg et al.

(10) Patent No.: US 8,807,398 B2
(45) Date of Patent: Aug. 19, 2014

(54) DISPENSER AND LIQUID CONTAINER

(75) Inventors: Robin Sundberg, Falun (SE); Per Möller, Borlänge (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/640,844

(22) PCT Filed: Apr. 4, 2011

(86) PCT No.: PCT/SE2011/050395

§ 371 (c)(1),
(2), (4) Date: Dec. 20, 2012

(87) PCT Pub. No.: WO2011/133085

PCT Pub. Date: Oct. 27, 2011

(65) Prior Publication Data

US 2013/0105519 A1 May 2, 2013

(30) Foreign Application Priority Data

Apr. 22, 2010 (WO) ..... PCT/SE2010/050446

(51) Int. Cl.

| | |
|---|---|
| ***B67D 7/76*** | (2010.01) |
| ***A47K 5/14*** | (2006.01) |
| ***A47K 5/12*** | (2006.01) |
| ***B05B 7/00*** | (2006.01) |

(52) U.S. Cl.

CPC ..... *A47K 5/14* (2013.01); *A47K 5/1207* (2013.01); *B05B 7/0037* (2013.01)

USPC ..... 222/190; 222/183; 222/321.7

(58) Field of Classification Search

CPC .... B65B 7/00; B65B 11/3057; A47K 5/1204; A47K 5/1205; A47K 5/1207; A47K 5/1211; A47K 5/1217; A47K 5/14; A47K 5/16

USPC ..... 222/190, 153.13, 183, 173, 628, 180, 222/181.1, 181.3, 182, 185.1, 321.1, 321.7, 222/321.9, 340, 341

See application file for complete search history.

(56) References Cited

U.S. PATENT DOCUMENTS

| | | | |
|---|---|---|---|
| 4,349,131 | A | 9/1982 | Arabian |
| 4,457,455 | A | 7/1984 | Meshberg |
| 4,477,000 | A | 10/1984 | Arabian |
| 4,993,600 | A | 2/1991 | Tucker et al. |

(Continued)

FOREIGN PATENT DOCUMENTS

| | | |
|---|---|---|
| CA | 2 164 341 | 10/1995 |
| EP | 0 392 238 | 10/1990 |

(Continued)

*Primary Examiner* — Lien Ngo

(74) *Attorney, Agent, or Firm* — Drinker Biddle & Reath LLP

(57) ABSTRACT

A dispenser includes a replaceable liquid container. A nozzle cap is arranged to at least partly enclose a foam pump during storage, transport and use of the replaceable liquid container. The nozzle cap is integral with the replaceable liquid container and is displaceable in the first direction so as to activate the foam pump in said first direction. The first end surface of the nozzle cap includes a dispensing opening aligned with the foam pump through which a quantity of liquid in the form of a foam is discharged upon activation of the foam pump.

41 Claims, 14 Drawing Sheets

(56) References Cited

U.S. PATENT DOCUMENTS

| | | | | |
|---|---|---|---|---|
| 5,048,750 | A | 9/1991 | Tobler | |
| 5,165,577 | A | 11/1992 | Ophardt | |
| 5,271,530 | A | 12/1993 | Uehira et al. | |
| 5,289,952 | A | 3/1994 | Gueret | |
| 5,348,189 | A | 9/1994 | Cater | |
| 5,443,569 | A | 8/1995 | Uehira et al. | |
| 5,445,288 | A | 8/1995 | Banks | |
| 5,779,104 | A | 7/1998 | Reidel | |
| 5,862,954 | A | 1/1999 | Ehrensperger et al. | |
| 6,082,586 | A * | 7/2000 | Banks | 222/95 |
| 6,536,629 | B2 * | 3/2003 | van der Heijden | 222/190 |
| 7,086,567 | B1 | 8/2006 | Ciavarella et al. | |
| 7,198,177 | B2 | 4/2007 | Ganzeboom | |
| 7,389,893 | B2 | 6/2008 | Kasting | |
| 7,611,033 | B2 | 11/2009 | Ganzeboom | |
| 7,735,688 | B2 * | 6/2010 | Foster et al. | 222/153.13 |
| 7,735,692 | B2 * | 6/2010 | Nelson | 222/190 |
| 8,313,008 | B2 * | 11/2012 | Ciavarella et al. | 222/135 |
| 8,336,740 | B1 * | 12/2012 | Daansen | 222/181.3 |
| 2004/0026453 | A1 * | 2/2004 | Cabarroque et al. | 222/153.13 |
| 2004/0232168 | A1 | 11/2004 | Ciavarella et al. | |
| 2006/0249538 | A1 | 11/2006 | Ophardt et al. | |
| 2007/0251953 | A1 * | 11/2007 | Criswell et al. | 222/105 |
| 2008/0023487 | A1 | 1/2008 | Douwes | |
| 2009/0032552 | A1 | 2/2009 | Ophardt et al. | |
| 2009/0184137 | A1 * | 7/2009 | O'Brien | 222/190 |
| 2009/0266842 | A1 * | 10/2009 | Snodgrass | 222/52 |
| 2009/0308894 | A1 * | 12/2009 | Ophardt | 222/190 |
| 2010/0059550 | A1 * | 3/2010 | Ciavarella et al. | 222/325 |
| 2010/0163580 | A1 * | 7/2010 | Ophardt et al. | 222/181.3 |

FOREIGN PATENT DOCUMENTS

| | | |
|---|---|---|
| EP | 0 565 713 | 3/1995 |
| EP | 0 618 147 | 5/1997 |
| EP | 0 703 831 | 12/1998 |
| EP | 0 650 687 | 10/1999 |
| GB | 712353 | 7/1954 |
| WO | 95/26831 | 10/1995 |
| WO | 95/29759 | 11/1995 |
| WO | 96/02178 | 2/1996 |
| WO | 96/21387 | 7/1996 |
| WO | 97/31563 | 9/1997 |
| WO | 98/16439 | 4/1998 |
| WO | 00/04812 | 2/2000 |
| WO | 03/041871 | 5/2003 |
| WO | 03/059524 | 7/2003 |
| WO | 2007/125355 | 11/2007 |
| WO | 2009/037417 | 3/2009 |

* cited by examiner

DISPENSER AND LIQUID CONTAINER

CROSS-REFERENCE TO RELATED APPLICATIONS

This application is a §371 National Stage Application of PCT International Application No. PCT/SE2011/050395 filed Apr. 4, 2011, which claims priority to PCT International Application No. PCT/SE2010/050446 filed Apr. 22, 2010, both of which are incorporated herein in their entirety.

TECHNICAL FIELD

The present disclosure relates to a dispenser, a liquid container and to a combination of a dispenser and a replaceable liquid container.

BACKGROUND

Liquid dispensers, particularly soap dispensers, of the type which contain a replaceable liquid container are becoming more and more popular. Using a replaceable liquid container allows users and suppliers to rapidly refill an empty dispenser, or to change the type of liquid dispensed without having to clean or change the dispenser itself.

Certain prior-art liquid dispensers have incorporated a foam pump into the dispenser, and not the replaceable liquid container. The liquid container only has the function of containing liquid, and is pierced, punctured or otherwise opened when refilling the dispenser. However, such arrangements cause problems due to liquid leaking from the container during its replacement, as the seal formed between the liquid container and the foam pump is not always tight. These problems are particularly noticeable with dispensers which dispense liquid from the bottom of the dispenser (i.e. in which the liquid container is upended when refilling the dispenser). A move has therefore been made towards liquid dispensers which have integral pump mechanisms.

Liquid containers having integral pump mechanisms can be activated by the user's hand on the pump mechanism. An example of this is provided in WO00/04812. Disadvantages with such arrangements include: direct force being applied to the foam pump (leading to wear and breakage of the pump mechanism), variations in the force applied to the pump mechanism, and the fact that dispensing action is generally limited to one direction (the direction of activation of the pump). Activation of an integral foam pump by direct action on the foam pump is not generally ergonomically effective, as the liquid tends to be dispensed on that part of the user's hand which is applying pressure to the pump mechanism.

Alternatively, the integral pump mechanisms of liquid containers can be activated by a dispensing mechanism which is integral with the dispenser. The user wishing to dispense liquid therefore activates the dispensing mechanism of the dispenser, which in turn activates the integral foam pump of the liquid container. For a manual dispenser, the dispensing mechanism of the dispenser typically includes a combination of levers, buttons, springs and other such actuators. Examples of such dispenser/liquid container combinations can be found in e.g. U.S. Pat. No. 6,082,586, EP 0 703 831, US2009/0032552, U.S. Pat. No. 5,445,288, CA 2 164 341, U.S. Pat. No. 7,086,567 and WO2007/125355.

Dispensers having integral dispensing mechanisms have the disadvantage that they require a number of moving parts within the dispenser, which may require regular maintenance or cleaning, and are often complicated and expensive to manufacture.

It is therefore desired to provide a simplified dispenser and liquid container combination; inter alia to reduce the number of moving parts in the dispenser. Further, it is to provide a simplified dispenser. A simpler dispenser would also improve the refilling process, making it easier to guarantee correct placement of the liquid container. A further object is to provide a simplified liquid container.

These, and further advantages will become apparent from the following description.

SUMMARY

There is provided a liquid container for a dispenser. The liquid container includes a liquid reservoir and a foam pump, such that activation of said foam pump in a first direction (V) discharges a quantity of said liquid in the form of a foam from said liquid reservoir via said foam pump.

A nozzle cap is arranged to at least partly enclose the foam pump during storage, transport, and use of the liquid container. The nozzle cap includes a first end surface extending perpendicular to said first direction (V). The nozzle cap is integral with the replaceable liquid container, and is displaceable in the first direction (V) so as to activate the foam pump in said first direction (V). The first end surface extending perpendicular to the first direction (V) is to be understood to encompass directions which are not parallel to the first direction (V).

The first end surface of the nozzle cap includes a dispensing opening aligned with the foam pump through which said quantity of said liquid in the form of a foam is discharged upon activation of said foam pump.

The foam pump may include at least one piston, at least one cylinder and at least one air chamber, wherein said at least one piston is located within said at least one cylinder and is displaceable in a first direction (V) within said cylinder. Upon activation of said foam pump, the at least one piston acts within the at least one cylinder so as to discharge a quantity of liquid from said liquid reservoir. The at least one air chamber is arranged such that activation of the foam pump compresses the air chamber so as to force air into the liquid in the foam pump, thus creating a foam.

The nozzle cap may include a flange extending at least partly in a direction perpendicular to said first direction (V). The flange may be located at a second end of said nozzle cap in said first direction (V).

The foam pump, the nozzle cap, and the dispensing opening in said first end surface of said nozzle cap may each have an axis of symmetry in the first direction (V), said axes of symmetry coinciding in the first direction (V).

The liquid container may further include a locking collar, said locking collar being arranged such that—in a first state (A) of said locking collar—the locking collar abuts the nozzle cap and prevents the displacement of said nozzle cap in said first direction (V), and—in a second state (B) of said locking collar—the nozzle cap can be displaced in said first direction (V).

The locking collar may be displaceable in the first direction (V) between said first state (A) and said second state (B).

There is also provided a combination of a dispenser and a replaceable liquid container, wherein said liquid container includes a liquid reservoir and a foam pump arranged such that activation of said foam pump in a first direction (V) discharges a quantity of said liquid in the form of a foam from said liquid reservoir via said foam pump.

The dispenser includes an actuator which is displaced directly by a user or displaced via a motor. A lifting arrangement being displaceable in the first direction (V) is situated between the actuator and the foam pump, said lifting arrangement being arranged so as to transfer the movement of said actuator to said foam pump in said first direction (V), so as to activate the foam pump.

The lifting arrangement may be integral with the replaceable liquid container or may be removable from the dispenser. The lifting arrangement may be integral with the replaceable liquid container. The lifting arrangement may include a nozzle cap which at least partly encloses the foam pump. The nozzle cap suitably includes a first end surface extending perpendicular to said first direction (V), said first end surface including a dispensing opening aligned with the foam pump to allow discharge a quantity of said liquid through said dispensing opening. Again, the first end surface extending perpendicular to the first direction (V) is to be understood to encompass directions which are not parallel to the first direction (V).

The nozzle cap may include a flange extending at least partly in a direction perpendicular to said first direction (V), said flange arranged to cooperate with said actuator of said dispenser.

The liquid container may further include a locking collar, said locking collar being arranged such that—in a first state (A) of said locking collar—the locking collar abuts the nozzle cap and prevents the displacement of said nozzle cap in said first direction (V), and—in a second state (B) of said locking collar—the nozzle cap can be displaced in said first direction (V). The locking collar may be displaceable in the first direction (V) between said first state (A) and said second state (B). The actuator is suitably an integral part of the dispenser.

The dispenser may include a housing for containing the liquid container. There is also provided a combination as set out above, wherein the liquid container is the liquid container described above.

According to an aspect, a liquid container for a dispenser includes a liquid reservoir and a foam pump. Activation of the foam pump in a first direction (V) discharges a quantity of said liquid in the form of a foam from the liquid reservoir via the foam pump. A nozzle cap is arranged to at least partly enclose the foam pump during storage, transport, and use of the liquid container. The nozzle cap includes a first end surface extending perpendicular to the first direction (V). The nozzle cap is integral with the replaceable liquid container. The nozzle cap is displaceable in the first direction (V) so as to activate the foam pump in the first direction (V). The first end surface of the nozzle cap includes a dispensing opening aligned with the foam pump through which the said quantity of the liquid in the form of a foam is discharged upon activation of the foam pump.

Since the nozzle cap is provided to activate the foam pump, dispensing of liquid from the liquid container is improved.

Again, the first end surface extending perpendicular to the first direction (V) is to be understood to encompass directions which are not parallel to the first direction (V).

According to embodiments, the foam pump may include at least one piston, at least one cylinder, and at least one air chamber. The at least one piston may be located within the at least one cylinder and may be displaceable in a first direction (V) within the cylinder such that, upon activation of the foam pump the at least one piston acts within the at least one cylinder so as to discharge a quantity of liquid from the liquid reservoir. The at least one air chamber may be arranged such that activation of the foam pump compresses the air chamber so as to force air into the liquid in the foam pump, thus creating a foam.

According to embodiments, the nozzle cap may include a flange extending at least partly in a direction perpendicular to the first direction (V). In this manner, the flange may form a point of action for a force applied to the nozzle cap in order to activate the foam pump.

According to embodiments, the flange may be located at a second end of the nozzle cap in the first direction (V).

According to embodiments, the foam pump, the nozzle cap, and the dispensing opening in the first end surface of the nozzle cap each may have an axis of symmetry in the first direction (V), the axes of symmetry coinciding in the first direction (V). In this manner the foam pump, the nozzle cap, and the dispensing opening may be aligned about one axis.

According to embodiments, the liquid container may include a locking collar, the locking collar being arranged such that—in a first state (A) of the locking collar—the locking collar abuts the nozzle cap and prevents the displacement of the nozzle cap in the first direction (V), and—in a second state (B) of the locking collar—the nozzle cap can be displaced in the first direction (V).

According to embodiments, the locking collar may be displaceable in the first direction (V) between the first state (A) and the second state (B).

According to embodiments, the container may include a portion provided with at least one protrusion and the nozzle cap may be provided with at least one groove. The at least one protrusion may engage in the at least one groove. In this manner, it may be ensured that the nozzle cap is held in place on the liquid container. When the groove is arranged along the first direction (V), it may be ensured that the displacement of the nozzle cap takes place in the first direction (V).

According to embodiments, the nozzle cap, in a first position, may be fixed in the first direction (V) by the protrusion engaging with the groove. The nozzle cap, in a second position, may be movable in the first direction (V). In this manner, the nozzle cap may be maintained fixed, and dispensing of the liquid in the liquid container may be prevented, e.g. during transport and handling, other than dispensing, of the liquid container.

According to embodiments, the nozzle cap may be arranged to be displaced between the first position and the second position by turning the nozzle cap in a direction substantially perpendicular to the first direction (V). In this manner, the nozzle cap may easily be twisted to prepare the nozzle cap, the foam pump and the liquid container for dispensing before the liquid container is placed in a dispenser.

According to a further aspect, a dispenser for a replaceable liquid container according to any of the above mention aspects and embodiments includes a foam pump arranged to be activated in a first direction (V). The dispenser includes a housing for containing the liquid container, and an actuator which is displaced directly by a user or displaced via a motor. The actuator is adapted to displace a nozzle cap in the first direction (V) so as to transfer a movement of the actuator to the foam pump. The nozzle cap is integral with the replaceable liquid container and arranged to at least partly enclose the foam pump.

Since the actuator is adapted for displacing the nozzle cap, dispensing of liquid from the liquid container may be performed in a simple and efficient manner.

According to embodiments, the actuator may be adapted to act directly on the nozzle cap.

According to embodiments, the actuator may be arranged to cooperate with a flange of the nozzle cap. The flange extends at least partly in a direction perpendicular to the first direction (V).

According to embodiments, the actuator may be an integral part of the dispenser.

According to embodiments, the actuator may include lugs arranged to engage with the nozzle cap.

According to embodiments, the actuator may be hinged to the dispenser about pivots.

According to embodiments, the dispenser may include engaging means for holding the liquid container in place in the dispenser.

According to embodiments, the engaging means may include a C-shaped element, which element is displaceable in a plane substantially perpendicularly to the first direction (V).

According to embodiments, the engaging means may be adapted to engage the liquid container by closing the housing of the dispenser.

According to a further aspect, a combination of a dispenser and a replaceable liquid container includes a liquid reservoir and a foam pump arranged such that activation of the foam pump in a first direction (V) discharges a quantity of the liquid in the form of a foam from the liquid reservoir via the foam pump. The dispenser includes an actuator which is displaced directly by a user or displaced via a motor. A lifting arrangement is displaceable in the first direction (V) and is situated between the actuator and the foam pump. The lifting arrangement is arranged so as to transfer the movement of the actuator to the foam pump in the first direction (V), so as to activate the foam pump. The lifting arrangement is integral with the replaceable liquid container or is removable from the dispenser (200).

Since the lifting arrangement is arranged to transfer the movement of the actuator to the foam pump, dispensing of liquid from the liquid container may be performed in a simple and efficient manner.

According to embodiments the lifting arrangement may be integral with the replaceable liquid container. In this manner, the lifting arrangement may readily be provided when the liquid container is placed in the dispenser.

According to embodiments, the lifting arrangement may include a nozzle cap which at least partly encloses the foam pump.

According to embodiments, the nozzle cap may include a first end surface extending perpendicular to the first direction (V). The first end surface may include a dispensing opening aligned with the foam pump to allow discharge of a quantity of the liquid through the dispensing opening. Again, the first end surface extending perpendicular to the first direction (V) is to be understood to encompass directions which are not parallel to the first direction (V).

According to embodiments, the nozzle cap may include a flange extending at least partly in a direction perpendicular to the first direction (V). The flange may be arranged to cooperate with the actuator of dispenser. In this manner, a user force applied to the actuator may be transferred to the nozzle cap and the foam pump.

According to embodiments, the liquid container may include a locking collar, the locking collar being arranged such that—in a first state (A) of the locking collar—the locking collar abuts the nozzle cap and prevents the displacement of the nozzle cap in the first direction (V), and—in a second state (B) of the locking collar—the nozzle cap may be displaced in the first direction (V).

According to embodiments, the locking collar may be displaceable in the first direction (V) between the first state (A) and the second state (B).

According to embodiments, the actuator may be an integral part of the dispenser. In this manner, the actuator is readily available for actuating the lifting arrangement once a liquid container has been placed in the dispenser.

According to embodiments, the actuator may be adapted to act directly on the lifting arrangement.

According to embodiments, the actuator may include lugs arranged to engage with the lifting arrangement. In this manner, a simple arrangement for engaging the actuator with the lifting arrangement may be provided. The term lug is to be interpreted as a projecting element, which protrudes from a portion of the actuator, such as e.g. a stud, a pin or a flange.

According to embodiments, the actuator may be hinged to the dispenser about pivots. In this manner, the actuator may pivot about a pivot axis when a user presses against the actuator to dispense liquid from the container. The pivots may form an integral part of the actuator, or the pivots may be formed by a separate axis, or the pivots may be integral with a housing of the dispenser.

According to embodiments, the dispenser may include engaging means for holding the liquid container in place in the dispenser. In this manner, reliable dispensing of liquid from the liquid container may be ensured.

According to embodiments, the engaging means may include a C-shaped element, which element is displaceable in a plane substantially perpendicular to the first direction (V). In this manner, it may be ensured that the liquid container is secured in the dispenser in the first direction (V), i.e. the direction in which a force is applied from the actuator to the lifting arrangement.

According to embodiments, the dispenser may include a housing for containing the liquid container.

According to embodiments, the engaging means may be adapted to engage the liquid container by closing the housing of the dispenser. In this manner, the liquid container may automatically be secured in the dispenser when the housing is closed.

According to embodiments, a combination according to embodiments mentioned above may include a liquid container according to any embodiments mentioned above.

Definitions

If a first component is defined as being "integral" with a second component, it is meant that the two components in question are connected together in an intimate fashion, and that the two components cannot be separated without damaging or destroying one or both components or their functions. Components which are integral are not meant to be separated from one another through the lifetime of the components in question—i.e. the components are substantially permanently connected. Connection of two "integral" components may e.g. be mechanical (e.g. through mechanical locks) or via adhesive, or by other such means.

BRIEF DESCRIPTION OF THE DRAWINGS

Embodiments of the invention will be described in more detail with reference to the appended schematic drawings, in which.

DETAILED DESCRIPTION OF EMBODIMENTS

Figure 1:
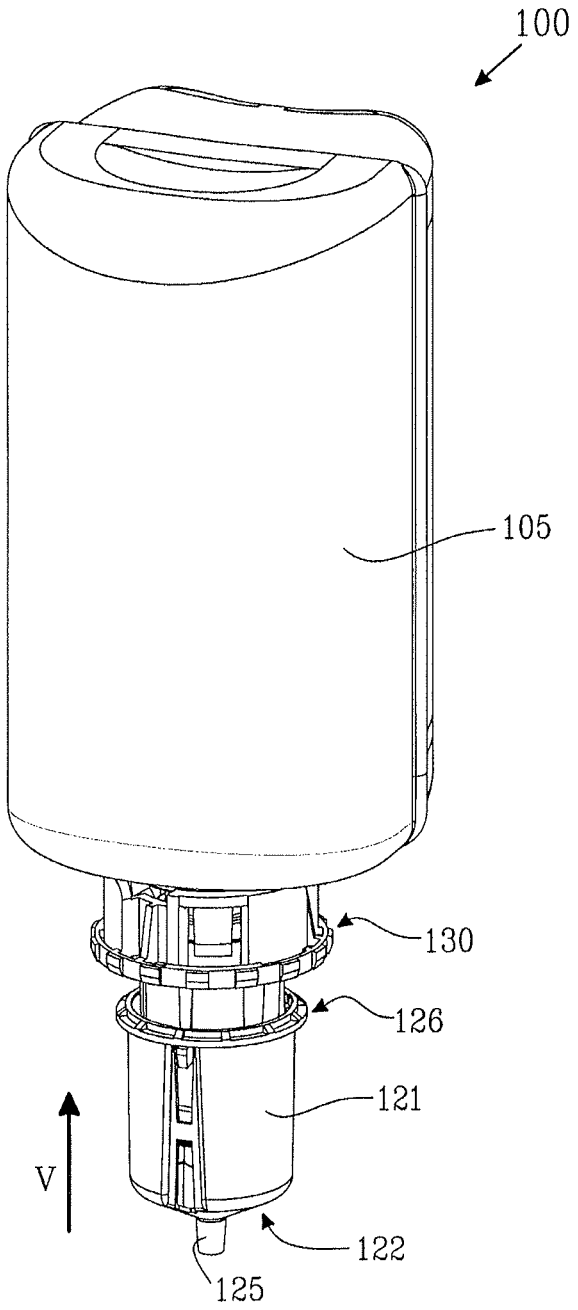
FIG. 1 shows a liquid container, FIG. 1A being an exploded view thereof.
Figure 1A:
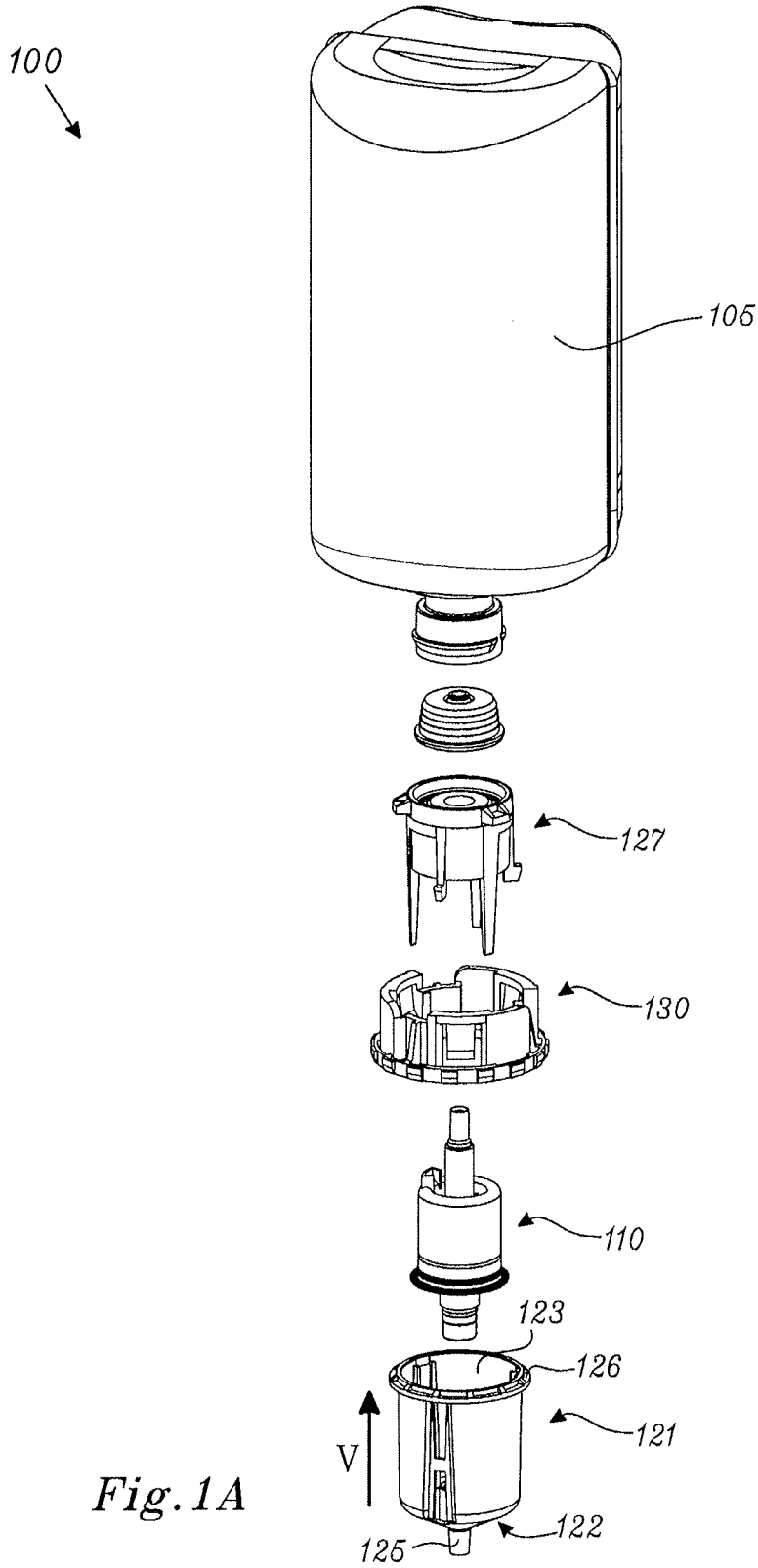

As shown in FIGS. 1-5, there is provided a liquid container 100. The liquid container 100 is designed to securely and safely store and transport liquid prior to use, and to be inserted into a dispenser 200 for dispensing of the liquid. The liquid container 100 is designed for use in dispensers 200, in which the dispensing takes place from the bottom of the dispenser (see FIGS. 6A and 6B).

The liquid container 100 includes a liquid reservoir 105 and a foam pump 110.

The liquid reservoir 105 is that portion of the liquid container 100 in which liquid is stored. It is shown as having a generally cylindrical form, but other three-dimensional forms are possible (e.g. cuboid). The reservoir 105 is hollow. The liquid reservoir 105 is suitably made of a material which tolerates the liquid contained, without degradation of the liquid or the liquid reservoir 105. Suitable materials for the liquid reservoir 105 are plastics, e.g. polyethylene or polypropylene.

As can be seen in FIG. 1, the liquid reservoir 105 may include two portions. One portion is softer than the other, and collapses as liquid is dispensed from the liquid reservoir 105. This construction avoids the problem with a build-up of vacuum within the liquid reservoir 105, while maintaining a portion of the reservoir 105 which is rigid, suitably for displaying information thereon.

The liquid contained within the liquid reservoir 105 is preferably soap or detergent. However, other liquids are conceivable. Other liquids include e.g. disinfectants, skin-care liquids (e.g. moisturizers) and even medicaments. The liquid is typically aqueous. The composition of the liquid within the liquid reservoir 105 can be varied by the skilled person depending on the nature of the liquid and the desired result.

The liquid container 100 includes a foam pump 110. The foam pump 110 acts to transfer liquid from the liquid reservoir 105 and dispense it in the form of a foam. Activation of the foam pump 110 in a first direction (V) discharges a quantity of said liquid in the form of a foam from said liquid reservoir 105 via said foam pump 110. As illustrated, the foam pump 110 is located at one end of the liquid reservoir 105, and the first direction (V) corresponds to the axis of the cylindrical liquid reservoir 105. The foam pump 110 also has a generally cylindrical form, but other shapes are possible.

Foam pumps 110 suitable for use may be available from Rexam Airspray. Additionally, those foam pumps described in U.S. Pat. No. 5,445,288 and WO 95/26831 are typical examples of foam pumps.

The foam pump 110 typically includes at least one piston 111, at least one cylinder 112 and at least one air chamber 113. The at least one piston 111 is located within said at least one cylinder 112 and is displaceable in a first direction (V) within said cylinder 112. Upon activation of the foam pump 110, the at least one piston 111 acts within said at least one cylinder 112 so as to discharge a quantity of liquid from said liquid reservoir 105. The at least one air chamber 113 is arranged such that activation of the foam pump 110 compresses the air chamber 113 so as to force air into the liquid in the foam pump 110, thus creating a foam. Various net or mesh materials may also be present in the foam pump 110 to promote foam formation. Constructional details of the foam pump 110 are provided in e.g. WO 95/26831.

As shown in FIGS. 1-4, a nozzle cap 121 is arranged to at least partly enclose the foam pump 110 during storage, transport, and use of the liquid container 100. The nozzle cap 121 provides protection for the foam pump 110 during storage, transport and use of the liquid container 100. It therefore encloses substantially the entire foam pump 110, as illustrated. The nozzle cap 121 may have a form which is similar to that of the foam pump 110, so that a close fit about the foam pump 110 can be achieved. In the illustrated case, the nozzle cap 121 is approximately cylindrical, although other forms are possible. The nozzle cap 121 encloses the foam pump 110 as it protrudes from the liquid reservoir 105. The nozzle cap 121 is arranged in sliding abutment with a connecting portion 127 arranged fixedly in relation to the liquid container 105. Thus, it may be ensured that the foam pump 121 is subject to forces substantially along an axis of the first direction.

Figure 2:
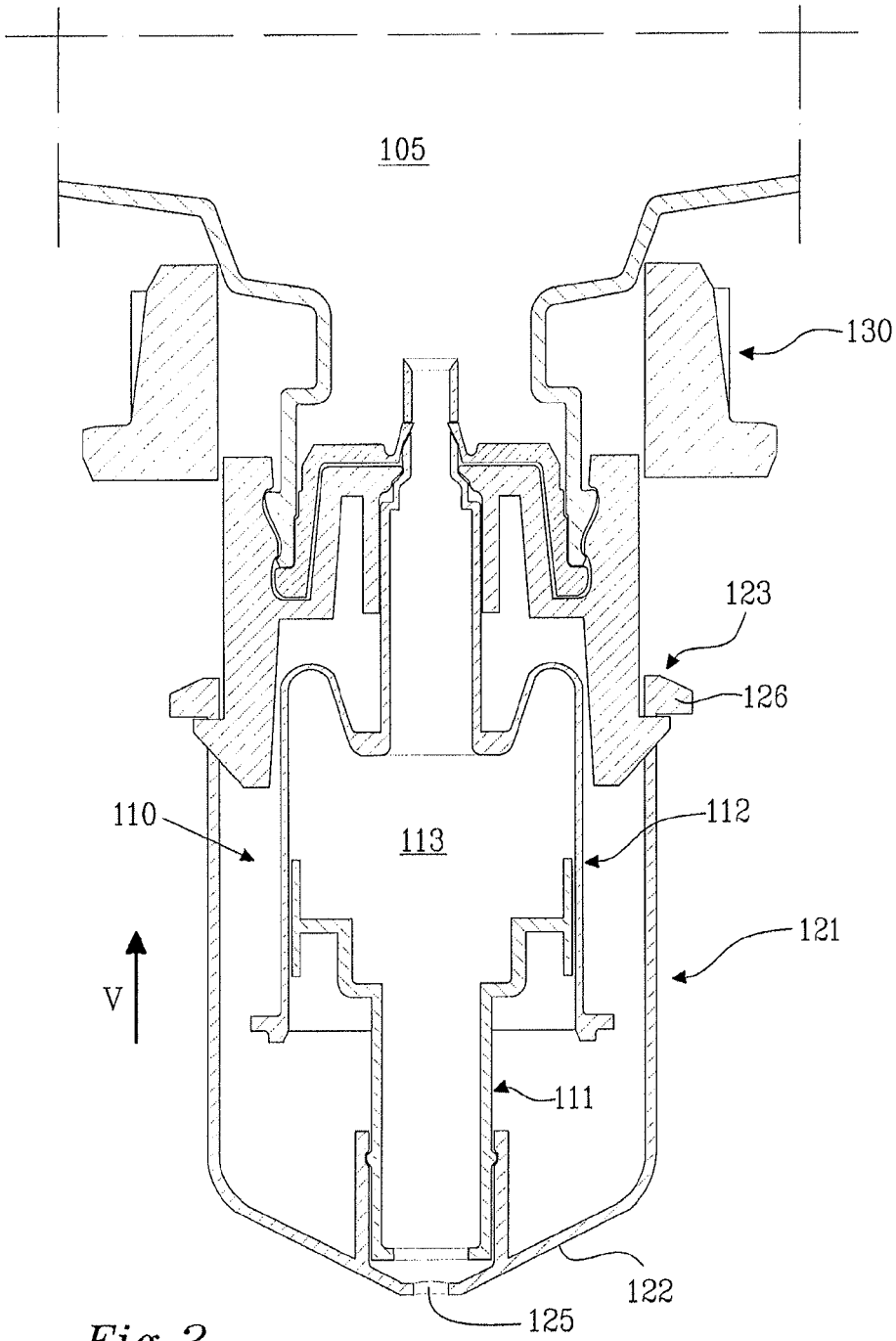
FIG. 2 is a view of the liquid container of FIG. 1, in cross-section through an axis of a foam pump, in an uncompressed state.
Figure 3:
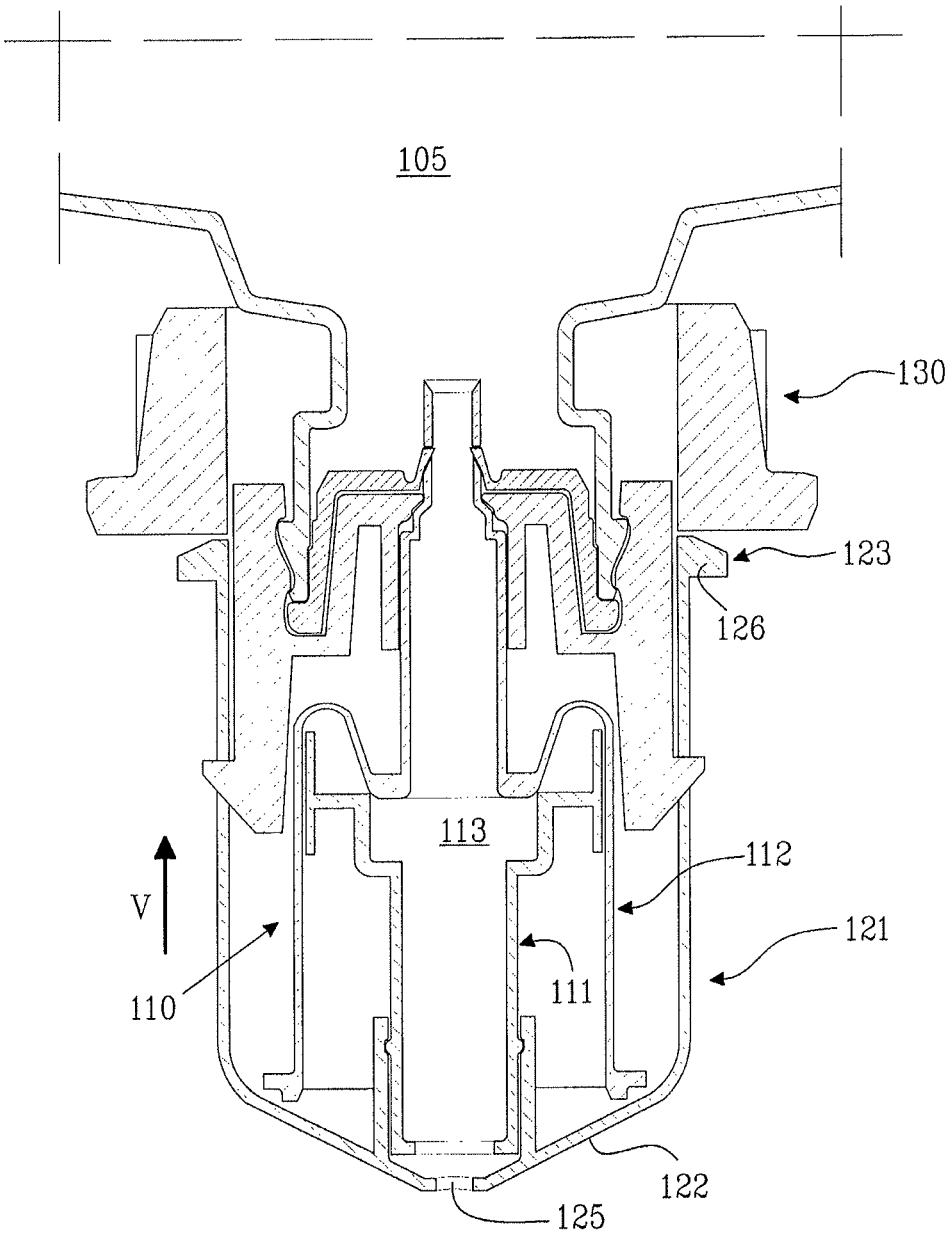
FIG. 3 shows the liquid container of FIG. 2 in a compressed state.

As shown, the nozzle cap 121 includes a first end surface 122 extending perpendicular to said first direction (V). The first end surface 122 is arranged at a first end of the nozzle cap 121. This first end surface 122 acts to protect the foam pump 110 and to apply pressure to the foam pump 110 under activation of said foam pump 110. The first end surface extending perpendicular to the first direction (V) is to be understood to encompass directions which are not parallel to the first direction (V). For instance, FIGS. 1-3 illustrate one example of such extension of the first end surface 122.

The nozzle cap 121 is integral with the replaceable liquid container 100. In other words, it is permanently joined to the liquid container 100, and cannot be removed therefrom without destroying the nozzle cap 121, the liquid container 100 and/or the function thereof. As shown in FIG. 1, the nozzle cap 121 is integrally connected to the liquid container 100 by means of hooks on the liquid container 100 which engage in grooves in the nozzle cap 121. Other arrangements which act to integrate the nozzle cap 121 with the liquid container 100 are also possible. Integration of the nozzle cap 121 with the liquid container 100 must be carried out such that displacement of the nozzle cap 121 is possible, as described in the following.

Importantly, nozzle cap 121 is displaceable in the first direction (V). This is achieved by the function of the grooves in the nozzle cap 121. Displacement of the nozzle cap 121 in the first direction (V) activates the foam pump 110, by compressing the foam pump 110 in said first direction (V). The foam pump 110 in uncompressed and compressed states is shown in FIGS. 2 and 3.

To allow the liquid in the form of a foam to be discharged from the liquid container 100 upon activation of the foam pump 110, the first end surface 122 of the nozzle cap 121 includes a dispensing opening 125. The dispensing opening 125 is aligned with the foam pump 110.

The nozzle cap 121 provides protection for the foam pump 110 during storage, transport, and use of the liquid container 100. However, in that the nozzle cap 121 remains integral with the liquid container 100 when the container 100 is placed in the dispenser 200, a safer, more leak proof solution is obtained. In addition, the nozzle cap 121 is not removed and discarded prior to the liquid container 100 being placed in the dispenser 200, meaning less waste.

As shown in FIGS. 1-5, the nozzle cap 121 may include a flange 126 extending at least partly in a direction perpendicular to said first direction (V). This flange 126 cooperates with the mechanism of the dispenser 200. As shown in FIGS. 1 and 2, the flange 126 may take the form of a protruding ring which extends from the nozzle cap 121 in substantially all directions. The flange 126 may also be present in only portions of the nozzle cap 121. Suitably, as shown in particular in FIGS. 1 and 2, the flange 126 is located at a second end 123 of said nozzle cap 121, seen along said first direction (V). The flange 126 being located at the second end 123 of the nozzle cap 121 means that the required lever effect can be placed on the nozzle cap 121. Further function of the flange 126 will be discussed below in relation to the mechanism of action of the dispenser 200.

Suitably, the foam pump 110, the nozzle cap 121, and the dispensing opening 125 in said first end surface 122 of said nozzle cap 121 each individually have an axis of symmetry in the first direction (V). The axis of symmetry may be rotational, reflectional, or translational. The axes of symmetry of these components should coincide in the first direction (V), and may coincide with an axis of symmetry of the entire liquid container 100. Most suitably, the foam pump 110, the nozzle cap 121, and the dispensing opening 125 have a substantially circular form in a plane perpendicular to the first direction (V), with the axis of symmetry of these components coinciding in the first direction (V) as shown in FIGS. 1-5.

The liquid reservoir 105 may also have an axis of symmetry extending in the first direction (V), which may or may not be aligned with one or more symmetry axes of the foam pump 110, the nozzle cap 121, and the dispensing opening 125.

As shown in FIG. 1, and in detail in FIGS. 4 and 5, the liquid container 100 may further include a locking collar 130. The locking collar 130 shown has the form of a ring extending about the foam pump 110. The locking collar 130 may extend fully or partially about the foam pump 110. The locking collar 130 acts to prevent the nozzle cap 121 from moving in the first direction (V) when such movement is not desired (e.g. during transport and storage of the liquid container 100). However, the locking collar 130 may be moved to another position on the liquid container 100, or completely removed therefrom when movement of the nozzle cap 121 in the first direction (V) is desirable (i.e. during dispensing of the liquid). In other words, the locking collar 130 is arranged such that—in a first state (A) of the locking collar 130—the locking collar 130 abuts the nozzle cap 121, preventing the displacement of the nozzle cap 121 in the first direction (V). In a second state (B) of said locking collar 130—the nozzle cap 121 can be displaced in said first direction (V).

Figure 4A:
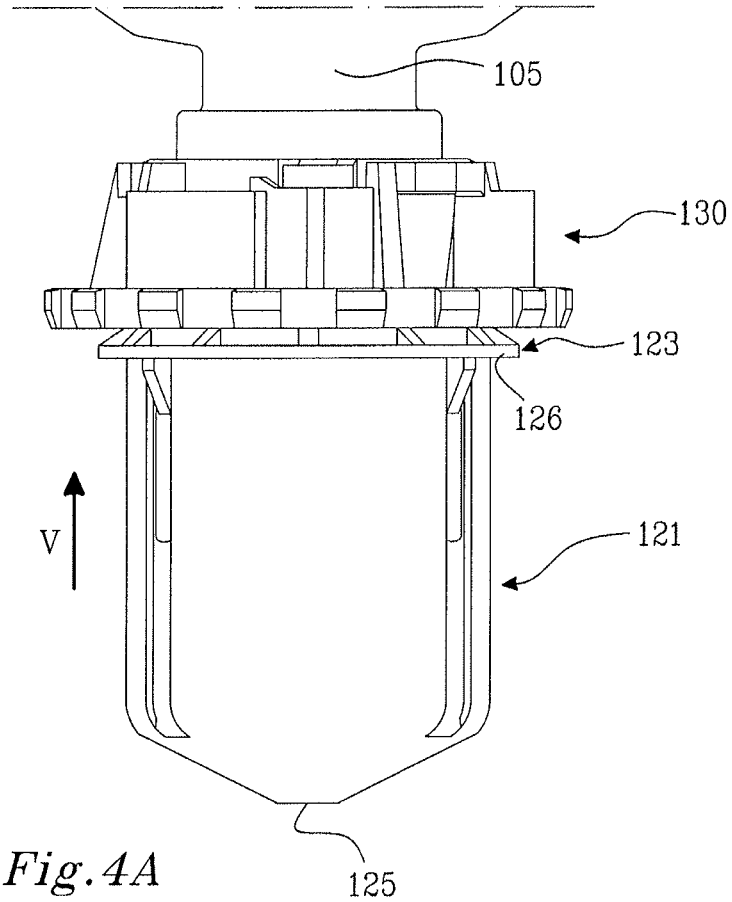
FIGS. 4A and 4B show one design of a locking collar.
Figure 4B:
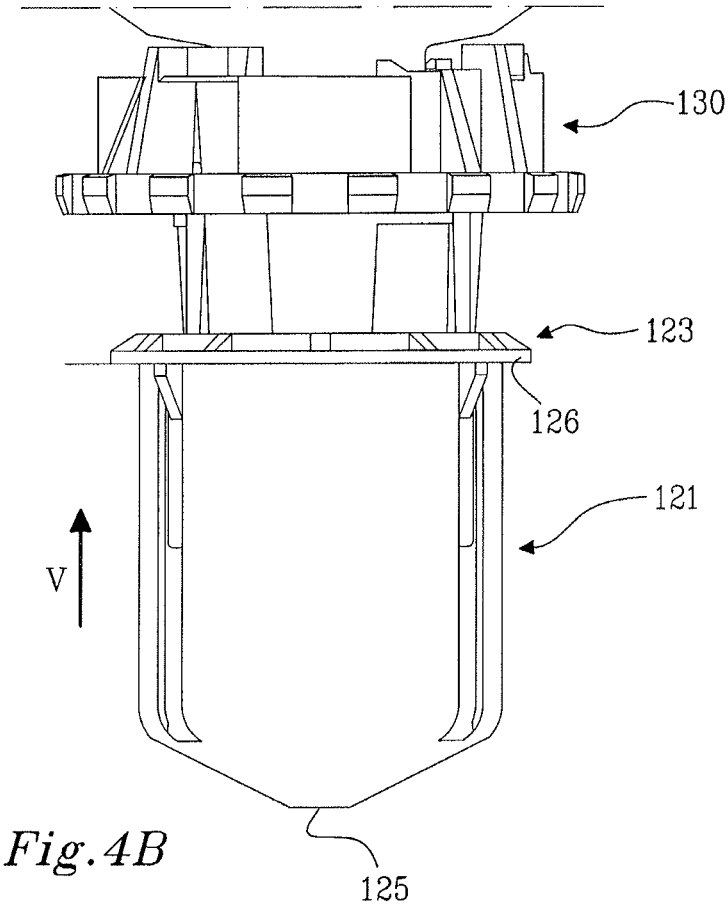

FIG. 4A illustrates one design for the locking collar 130. In FIG. 4A, the locking collar 130 abuts the nozzle cap 121, and is maintained in this state (A) by means of locking elements on the liquid container 100 which engage with corresponding locking elements on the locking collar 130. Twisting the locking collar 130 releases the locking elements, allowing the locking collar 130 to be displaced in the first direction to a second state (B), in which the locking collar 130 does not abut the nozzle cap 121. In this second state (B), the nozzle cap 121 is free to move in the first direction (V), and liquid can be dispensed. Suitably, therefore, the locking collar 130 is displaceable in the first direction (V) between said first state (A) and said second state (B). Suitably, the locking collar 130 may be locked in position in both state (A) and state (B).

Figure 5A:
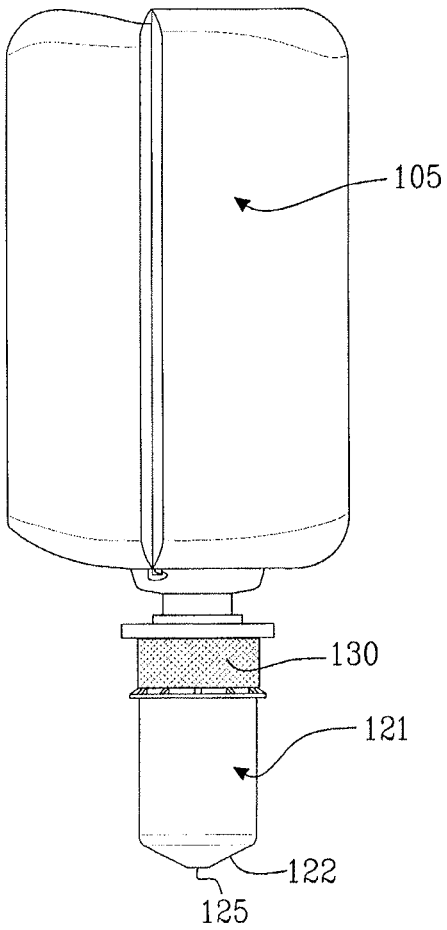
FIGS. 5A and 5B show another design of a locking collar.
Figure 5B:
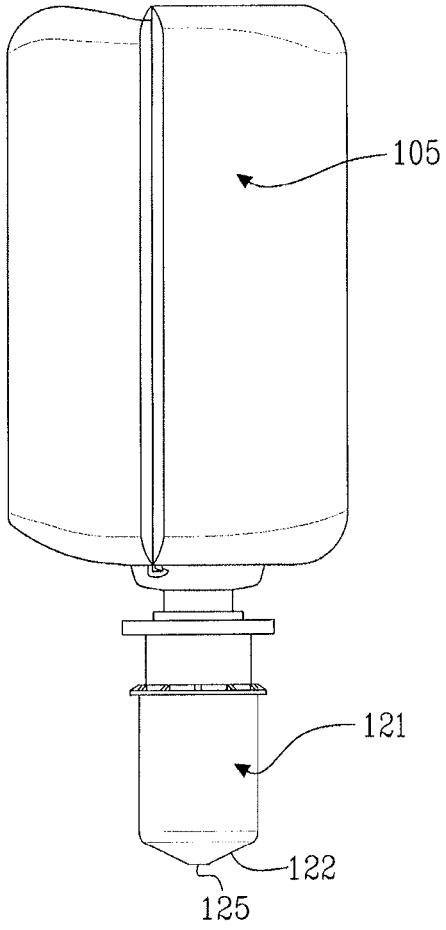
Figure 6A:
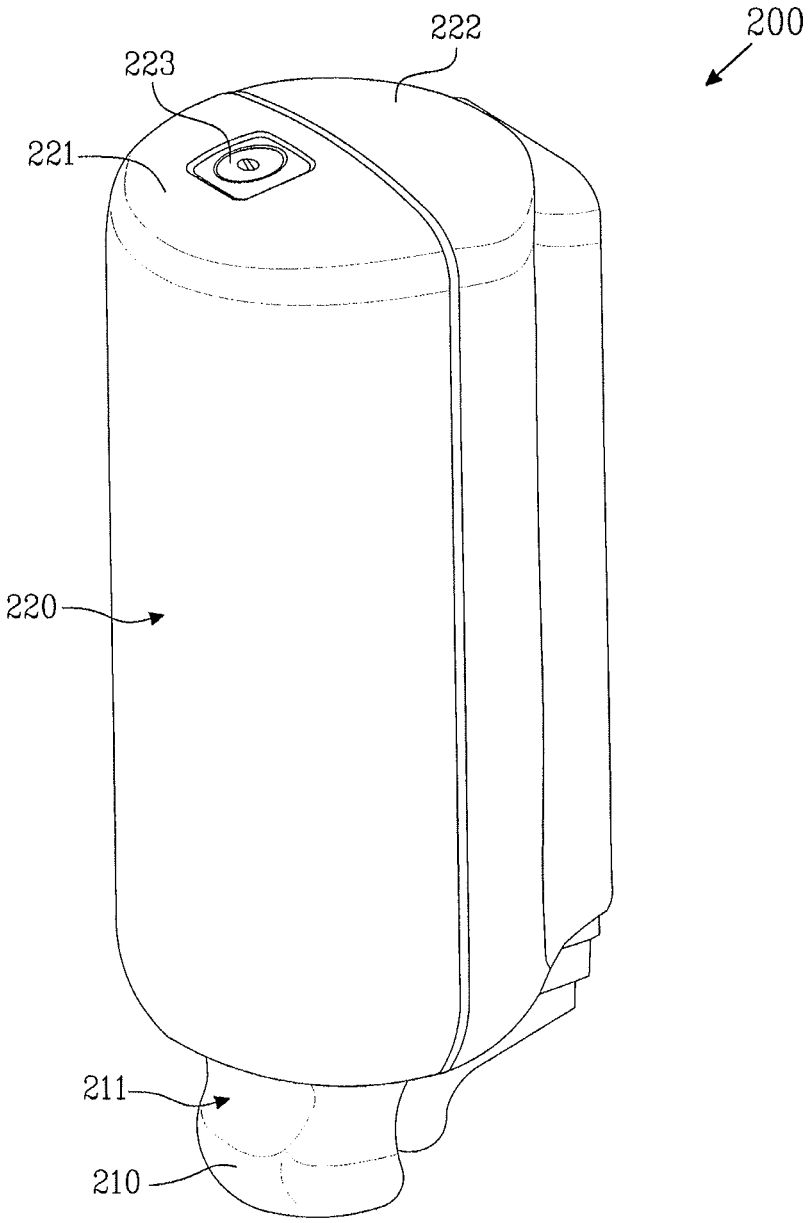
FIG. 6A shows the combination of a dispenser and a replaceable liquid container.
Figure 6B:
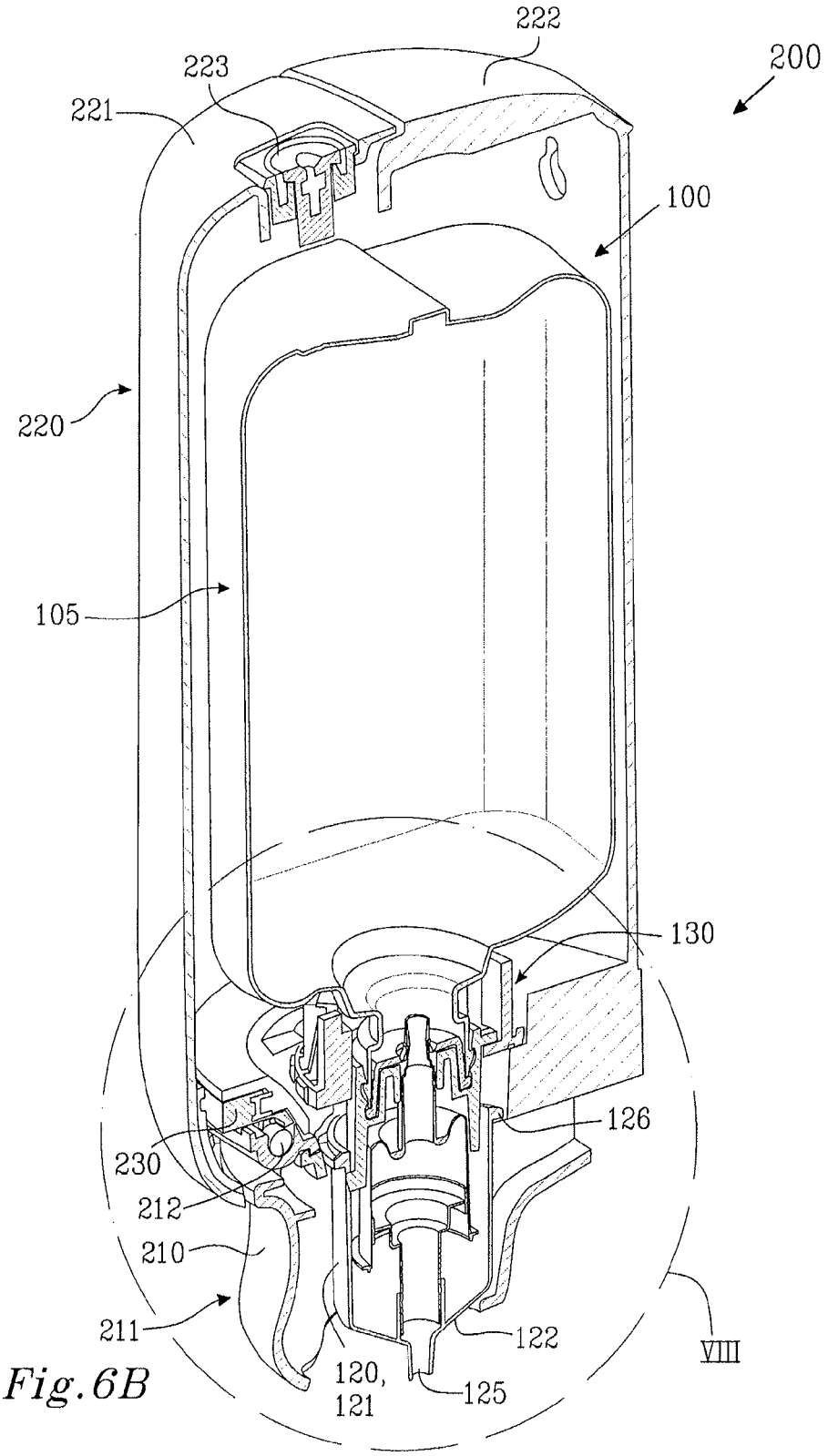
FIG. 6B is a cross-sectional view through the dispenser/container.

FIGS. 5A and 5B illustrate an alternative design for the locking collar 130. In FIGS. 5A and 5B, the locking collar 130 is in the form of a removable ring. In the first state (A), the locking collar 130 abuts the nozzle cap 121. The locking collar of FIG. 5A can be completely removed from the liquid container 100 by a user, to provide the second state (B), shown in FIG. 5B, in which the nozzle cap 121 is free to move in the first direction (V), so that liquid can be dispensed.

Figure 5C:
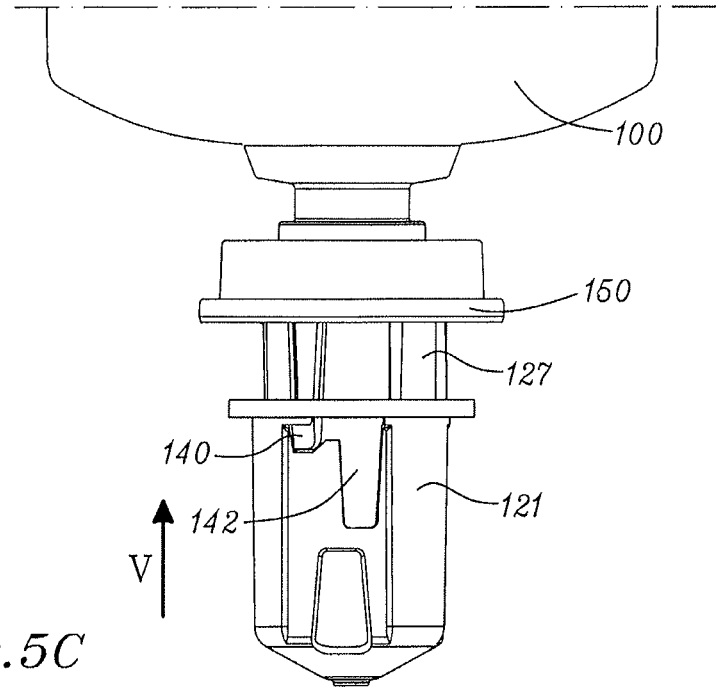
FIGS. 5*c* and 5*d* illustrate alternative embodiments of a liquid container.
Figure 5D:
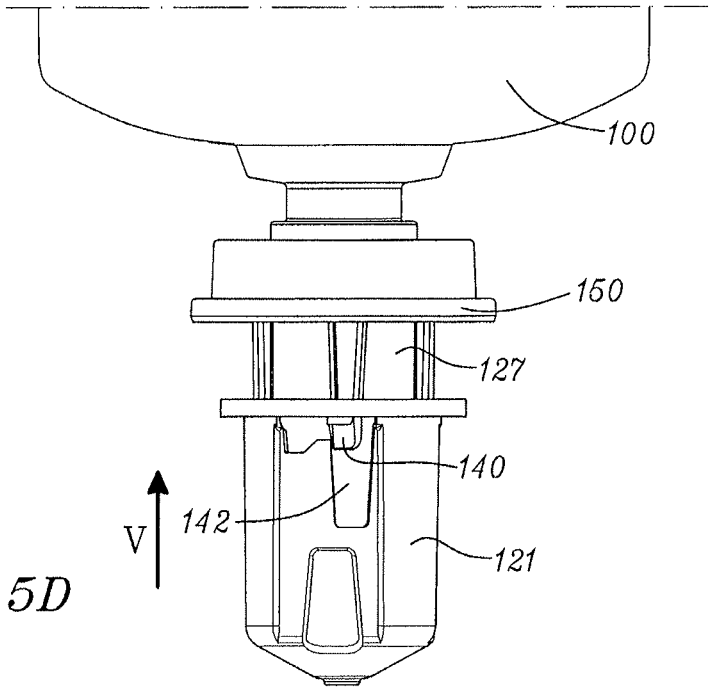

FIGS. 5*c* and 5*d* illustrate alternative embodiments of a liquid container 100 including a foam pump arranged at least partially within a nozzle cap 121. The nozzle cap 121 is adapted to be releasably fixed in relation to the container 100. When the nozzle cap 121 is fixed in relation to the container 100, the nozzle cap 121, and accordingly also the foam pump, cannot be displaced in a first direction (V). The nozzle cap 121 is integrally connected to the liquid container 100 by means of at least one protrusion, e.g. in the form of a hook 140, arranged on a connecting portion 127 of the liquid container 100. The at least one hook 140 engages in at least one groove 142 in the nozzle cap 121.

FIG. 5*c* illustrates the nozzle cap 121 in a fixed position. The groove 142 has an upside down L-shaped form. When the hook 140 is placed in the horizontal portion of the groove 142, the nozzle cap is fixed in the first direction (V). By turning the nozzle cap 121 to a position in which the hook 140 is placed in the vertical portion of the groove 142, as illustrated in FIG. 5*d*, the nozzle cap 121 is released. The foam pump may thus be actuated by displacing the nozzle cap 121 in the first direction (V).

Figure 7:
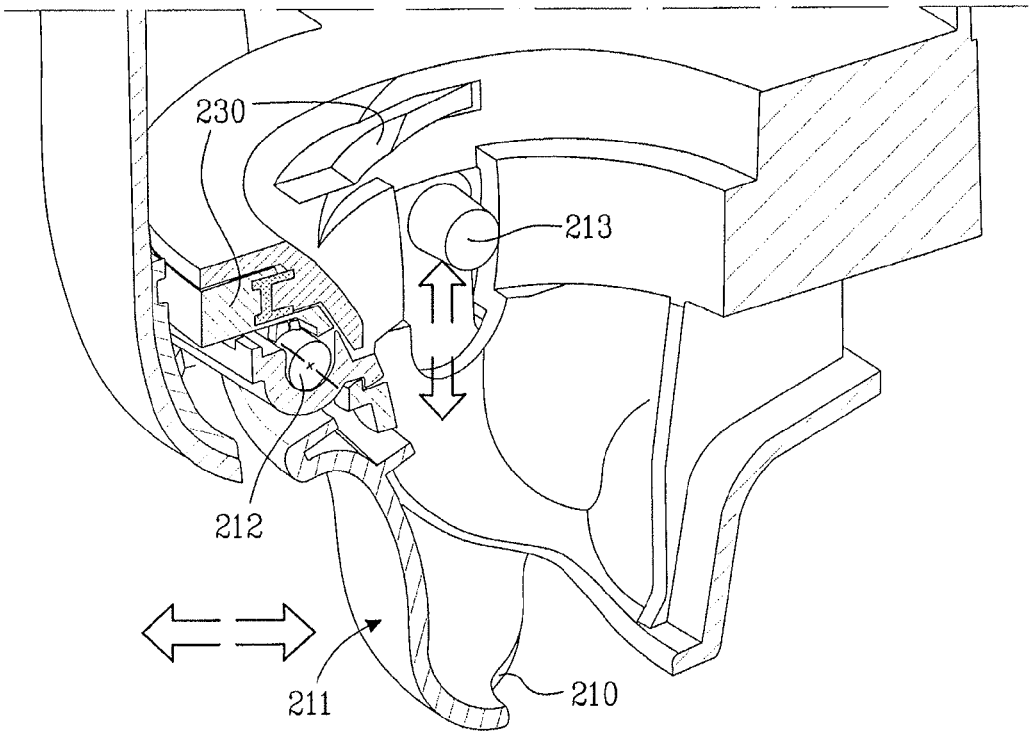
FIG. 7 shows a cross-sectional view of a mechanism of a dispenser, with an activator depressed.
Figure 8:
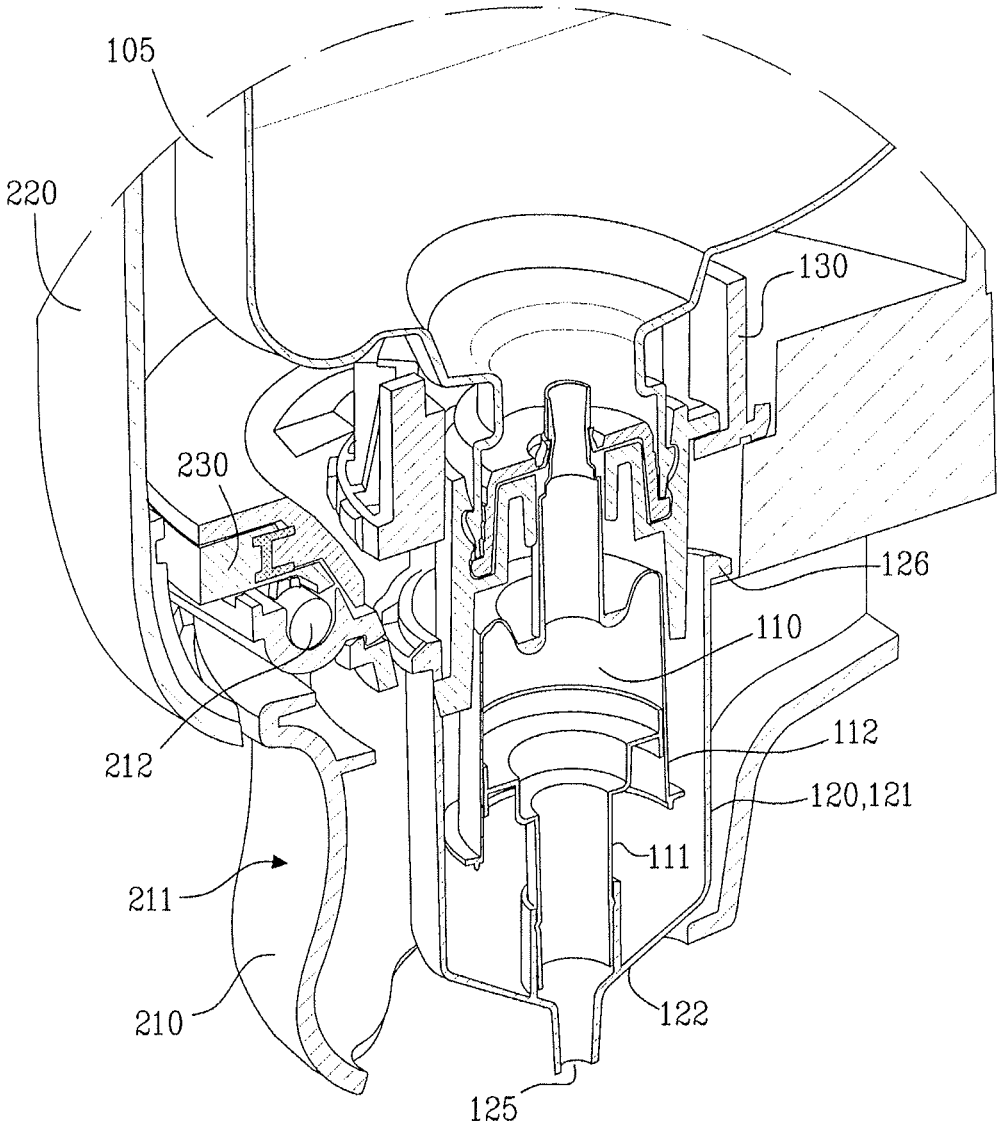
FIG. 8 shows a similar cross-sectional view as FIG. 7, but with a liquid container in place.

There is also provided a combination of a dispenser 200 and a replaceable liquid container 100, as shown in FIGS. 6-8. The dispenser 200 is placed in a location where the liquid is to be used (e.g. a bathroom, hospital or kitchen). When liquid in the form of a foam is desired, the dispenser 200 is activated, which in turn activates the foam pump 110 and dispenses foam. The dispenser 200 illustrated is designed for mounting on a vertical surface (e.g. a wall or a door), and foam is dispensed from the lower end of the dispenser 100. The dispenser 200 may therefore include mounting means for mounting the dispenser 200 on the vertical surface. The liquid container 100 is therefore mounted within the dispenser 200 with the liquid reservoir 105 located vertically above the foam pump 110. Other designs are also possible e.g. legs to allow the dispenser to stand on a horizontal surface, or an alternative arrangement of the liquid container 100.

The dispenser 200 illustrated includes a housing 220 for containing the liquid container 100. The housing 220 shown includes a first portion 221 and a second portion 222. The first and second portions 221, 222 are hinged against one another, and fasten via a lock 223. Other fastening means between the first and second portions 221, 222 are conceivable. In the illustrated embodiment, the first portion 221 includes the front side of the housing 220, while the second portion 222 includes the rear side of the housing 220, and the two portions are hinged towards the bottom of the housing 220, although other designs are also possible. Housing 220 may be made of any suitable materials, e.g. plastic or metal.

Housing 220 holds the liquid container 100 in place, and protects it from damage and theft. A housing 220 is not entirely necessary, however, and the liquid container 100 may be held in place in the dispenser 200 by other means (e.g. elastic straps, mechanical engagement between the liquid container 100 and the dispenser 200, or simply by gravitational forces).

The liquid container 100 for use in the dispenser includes a liquid reservoir 105 and a foam pump 110. The liquid reservoir 105 and foam pump 110 are arranged such that activation of said foam pump 110 in a first direction (V) discharges a quantity of said liquid in the form of a foam from said liquid reservoir 105 via said foam pump 110. The nature and mechanism of action of the liquid reservoir 105 and foam pump 110 are as described above in relation to FIGS. 1-5.

The dispenser 200 includes an actuator 210 which is displaced directly by a user or displaced via a motor, under operation of the dispenser 200. The actuator 210 translates a displacement effected by the user or the motor into a displacement suitable to dispense liquid foam (i.e. a displacement in the first direction (V) of the liquid container 100). Displacement of the actuator 210 shown in the Figures is performed directly by the user. However, it is also possible that the dispenser 200 includes an electric motor which is actuated by a user (e.g. by a push-button, lever, IR sensor etc.) so as to displace the actuator 210. The actuator 210 is a separate component of the dispenser 200 to the lifting arrangement 120. Displacement of the actuator 210 is usually in a direction other than the first direction (V).

The actuator 210 is shown in detail in FIG. 7. The actuator 210 shown in the Figures includes an actuator surface 211 which is depressed by a user, pivots 212 about which the actuator 210 is hinged to the dispenser 200, and lugs 213 which engage the lifting arrangement 120 of the liquid container 100 described herein. The actuator surface 211 is depressed by the heel of the user's hand, and liquid in the form of a foam is dispensed into the user's palm. Alternative designs for the actuator are possible, e.g. in which the actuator 210 is reversed and the actuator surface 211 is pulled by one or more fingers of the user and foam is dispensed into the user's palm. The pivots 212 may form part of the actuator 210 or of the dispenser housing 220, alternatively the pivots 212 may form part of a separate axle.

The actuator 210 suitably includes a single component, as shown in FIG. 7. That is, when the actuator 210 is depressed by a user, it acts directly on the lifting arrangement 120 described herein, with no intervening components. The actuator 210 is suitably an integral part of the dispenser 200.

A lifting arrangement 120 being displaceable in the first direction (V) is situated between said actuator 210 and said foam pump 110. The lifting arrangement 120 is arranged so as to transfer the movement of the actuator 210 to the foam pump 110 in said first direction (V), so as to activate the foam pump 110. The lifting arrangement 120 is integral with the replaceable liquid container 100 (i.e. permanently attached thereto) or is removable from the dispenser 200 (i.e. it includes a separate component to the liquid container 100 and the dispenser 200).

The lifting arrangement 120 has a form which allows the forces applied by the actuator 210 to be applied to the foam pump 110. As illustrated, the lifting arrangement 120 has a form which engages with the lugs 213 of the actuator 210 at opposite sides of the dispenser, and a surface which acts on the foam pump 110 to dispense foam. The lifting arrangement 120 is suitably directly coupled to the foam pump 110 and directly coupled to the actuator 210. The lifting arrangement must also allow foam to pass from the foam pump to the outside of the dispenser 200.

The lifting arrangement may include a nozzle cap 121 which at least partly encloses the foam pump 110, as described above for the liquid container 100, and as illustrated in FIGS. 1-5. In this embodiment, the dispenser 200 is particularly suited for the liquid container 100 described herein. Therefore, a combination of liquid container 100 and dispenser 200, wherein the liquid container 100 is the liquid container 100 described in relation to FIGS. 1-5 may be provided.

As described above in relation to the liquid container 100, in particular embodiments, the nozzle cap 121 is integral with the replaceable liquid container 100. As described above, the nozzle cap 121 includes a first end surface 122 extending perpendicular to said first direction (V), said first end surface 122 including a dispensing opening 125 aligned with the foam pump 110 to allow discharge of a quantity of said liquid through said dispensing opening 125. Other details of the nozzle cap 121 are disclosed in relation to the liquid container 100 described above.

As set out above, the nozzle cap 121 suitably includes a flange 126 extending at least partly in a direction perpendicular to said first direction (V), said flange 126 arranged to cooperate with said actuator 210 of said dispenser 200. In that the flange 126 is located at the second end 123 of the nozzle cap 121, as illustrated, suitable lever arm effects can be obtained in the dispenser 200. However, other arrangements are possible. In the embodiments illustrated in FIGS. 7 and 8, the flange 126 engages with the lugs 213 of the actuator 210 when the dispenser 200 is activated. Details of the flange 126 are the same as those disclosed above in relation to the liquid container 100.

The term lug is to be interpreted as a projecting element, which protrudes from a portion of the actuator 210, such as e.g. a stud, a pin or a flange. A lug may form an integral part of the actuator 210.

Figure 9:
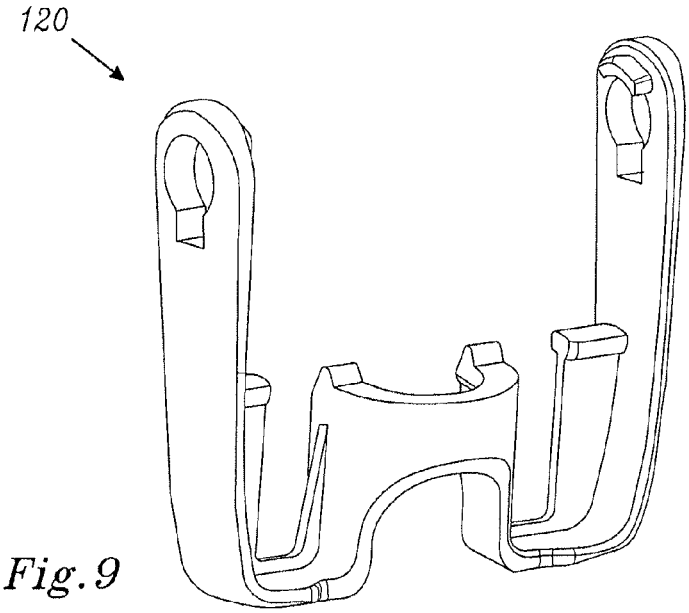
FIG. 9 shows an alternative lifting arrangement to a nozzle cap.

Part of an alternative lifting arrangement 120 is shown in FIG. 9. The lifting arrangement 120 shown in FIG. 9 includes a yoke, with arms arranged to engage with the lugs 213 of the actuator 210 and an inner surface arranged to engage with the foam pump 210. The lifting arrangement 120 of FIG. 9 functions in a similar way to the nozzle cap 121 of the preceding embodiments. The lifting arrangement 120 of FIG. 9 may be removable from both the dispenser 200 and the liquid container 100.

Figure 10A:
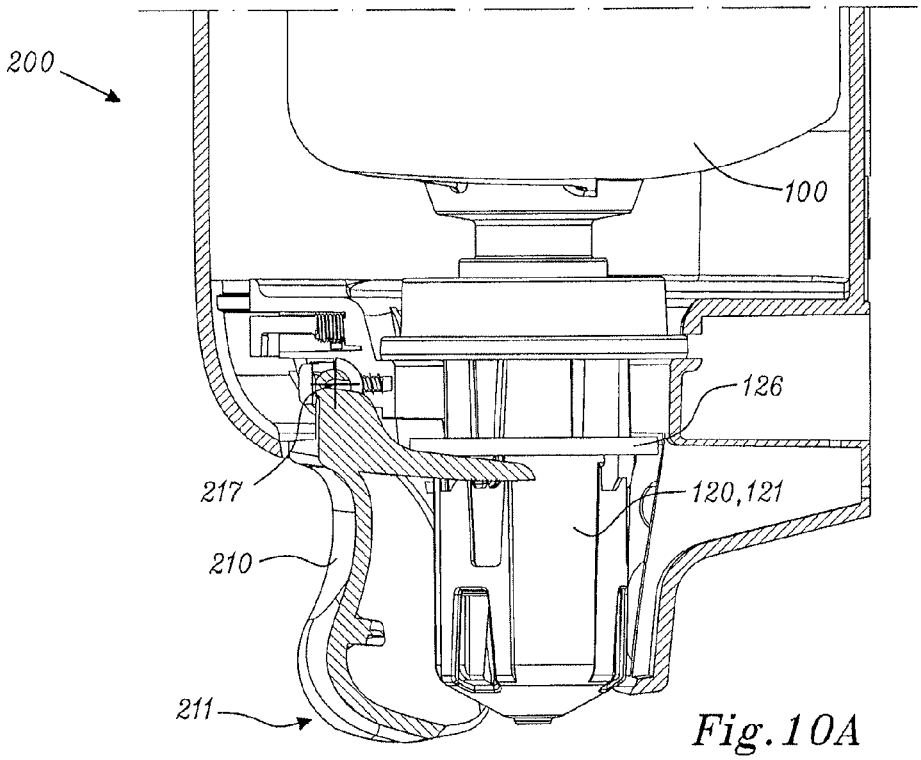
FIGS. 10*a* and 10*b* illustrate cross sections through part of a dispenser and a liquid container according to embodiments.
Figure 10B:
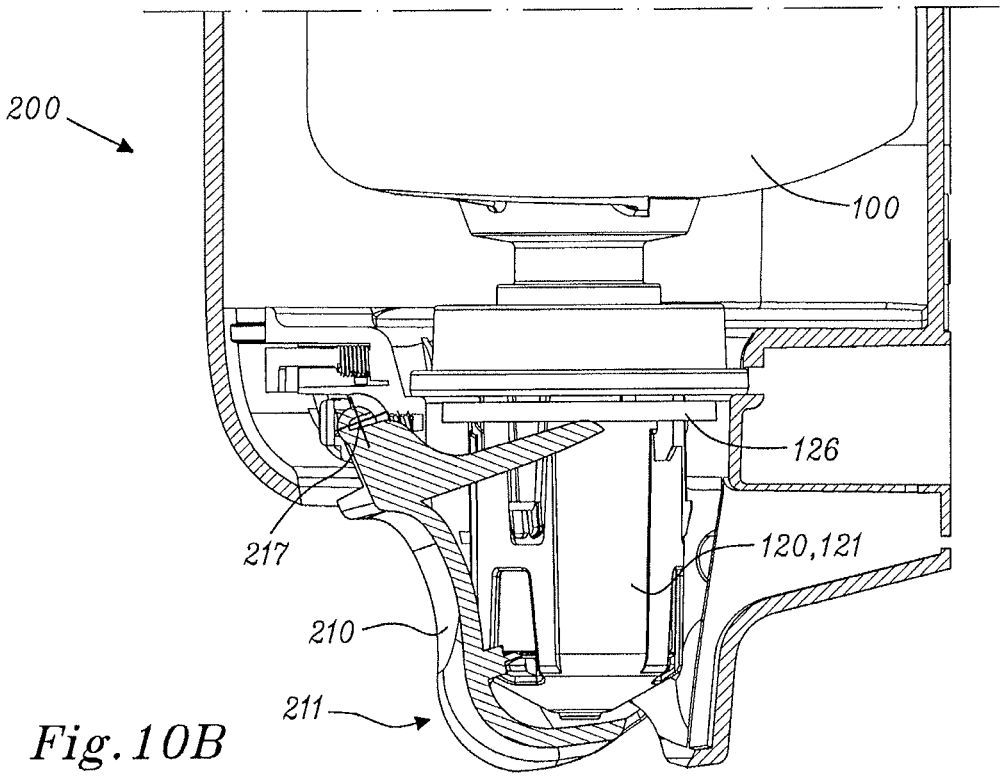
Figure 10C:
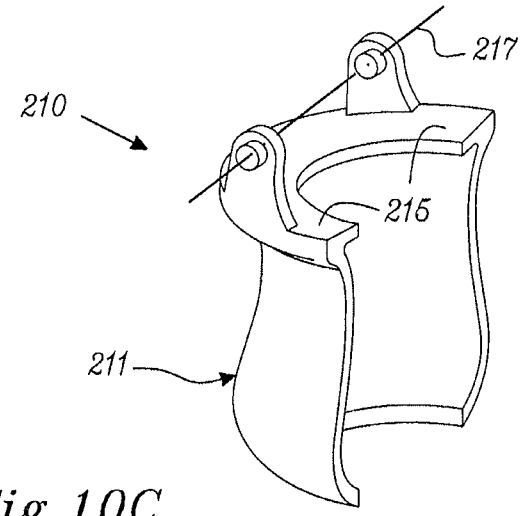
FIG. 10*c* illustrates a perspective view of an actuator of the FIGS. 10*a* and 10*b* embodiments.

FIGS. 10*a* and 10*b* illustrate cross sections through part of a dispenser 200 and a liquid container 100 according to embodiments. FIG. 10*c* illustrates a perspective view of an actuator 210 of the FIGS. 10*a* and 10*b* embodiments. The liquid container 100 includes a foam pump arranged at least partially inside a lifting arrangement 120 including a nozzle cap 121. The nozzle cap 121 includes a flange 126.

The actuator 210 includes an actuator surface 211 which is arranged to be pressed against by a user, and two lugs 215 in the form of two ledges 215. The actuator is arranged to pivot about a pivot axis 217. The ledges 215 are arranged to abut against the flange 126 of the nozzle cap 121, at least when a user presses against the actuator surface 211.

When dispensing a portion of foamed liquid from the liquid container 100, a user presses against the actuator surface 211 when the actuator 210 is in the position illustrated in FIG. 10*a*. The force applied by the user is transferred via the ledges 215 to the flange 126 of the nozzle cap 121. The actuator 210, the nozzle cap 121, and the foam pump are thus, subjected to a dispensing stroke. During the dispensing stroke the actuator 210 pivots about the pivot axis 217. FIG. 10*b* illustrates the actuator 210 and the nozzle cap 121 at an end of the dispensing stroke.

As in the embodiments of FIGS. 7 and 8, in the embodiments of FIGS. 10*a*-10*c* a first lever arm extends between the pivot axis 217 and the actuator surface 211, and a second lever arm extends between the pivot axis 217 and an abutment point between the lugs 213, 215, and the flange 126. The first lever arm may be longer than the second lever arm. In such a manner, the force being applied from the lugs 213, 215 to the flange 126 will be higher than the force applied by a user to the actuator surface 211.

The illustrated combination of the dispenser 200 and the liquid container 100 functions as follows: the actuator surface 211 is depressed by a user, causing the actuator 210 to pivot about pivots 212. The movement is thus translated into a displacement in the first direction (V). Lugs 213 located on the actuator 210 engage the lifting arrangement 120 (nozzle cap 121 or lifting arrangement 120 according to FIG. 9) of the liquid container 100 described herein. The lifting arrangement 120 applies pressure to the foam pump 110 in the first direction (V) and liquid in the form of a foam is dispensed into the user's palm.

As described above for the liquid container 100, the liquid container may further include a locking collar 130. The locking collar 130 is arranged such that—in a first state (A) of said locking collar 130—the locking collar 130 abuts the nozzle cap 121 and prevents the displacement of said nozzle cap 121 in said first direction (V). In a second state (B) of said locking collar 130—the nozzle cap 121 can be displaced in said first direction (V). The locking collar 130 is suitably displaceable in the first direction (V) between said first state (A) and said second state (B). Suitably, the locking collar 130 may be locked in position in state (A) and state (B). Details of the locking collar 130 are described above in relation to FIGS. 4A, 4B, 5A and 5B.

Notably, the actuator 210, the lifting arrangement 120 and the foam pump 110 may be separate components of the combination of dispenser 200 and liquid container 100.

Apart from the actuator 210 and the housing 220, the dispenser 200 may include one or more additional components, such as locks 223, internal supports for the liquid container 100, mounting means for mounting the dispenser 200 on a vertical surface (e.g. a wall), hinges to allow the housing 220 to open, and windows to show the contents. The nature, design and incorporation of such components into the dispenser 200 of embodiments of the present invention will be apparent to the person skilled in the art.

In a particular embodiment, illustrated in FIGS. 7 and 8, the dispenser 200 includes engaging means 230 which engages with the liquid container 100. Engaging means 230 acts to hold the liquid container 100 in place in the dispenser 200, so that effective dispensing can occur without undesired displacement of the liquid container 100 (e.g. in the first direction (V)). As such, the engaging means 230 should not be displaceable in the first direction (V). The engaging means 230 may engage with the locking collar 130 of the liquid container 100, or may engage with the liquid reservoir 105, the foam pump 110, or some other location on the liquid container 100. An engaging flange 150 as illustrated in FIGS. 5*c* and 5*d* may be provided on the container 100 inter alia for the purpose of being engaged with the engaging means 230 of the dispenser 200. The engaging means should not engage with the lifting arrangement 120 or nozzle cap 121, as these components are designed to be displaceable in the first direction (V).

The engaging means 230 may be designed so that only a certain design of liquid container 100 (e.g. with certain contents) can be used in combination with the dispenser 200. For example, the engaging means 230 may have a pattern of cut-outs or protrusions which engages with a corresponding pattern on the liquid container 100, so that only the desired liquid container 100 can engage with the engaging means 230.

Engaging means 230 can take a number of forms, e.g. a bayonet-type fitting, a screw-fitting, one or more moveable jaws or a "click"-fitting in the dispenser 200 into which the liquid container 100 engages. The engaging means 230 may be a fixed component of the dispenser 200, or may be moveable within said dispenser 200. If the engaging means 230 is moveable within the dispenser 200, it may be sprung or otherwise resiliently arranged such that it is displaced upon insertion of the liquid container 100 into the dispenser 200, but returns to an engaged position upon correct placement of the liquid container 100. Engaging means 230 may also be manually activated or activated by closing the housing 220 of the dispenser 200. The engaging means 230 may include one or more angled surfaces which promote correct insertion and engagement of the liquid container 100 in the dispenser 200. The engaging means 230 may be resiliently suspended in the dispenser 200 such that when the housing 220 is open, the engaging means 230 is held in an open position by e.g. a spring. A liquid container 100 to be replaced may be removed from the dispenser 200 and a new liquid container 100 may be placed in the dispenser 200. When the housing 220 is being closed, the engaging means 230 is pushed by the housing 220 against the spring into an engaged position, in which the new liquid container 100 is engaged.

A particular engaging means 230 is shown in FIGS. 7 and 8. The illustrated engaging means 230 includes a C-shaped element which can be displaced in a plane perpendicular to the first direction (V). The engaging means 230 is coupled to the housing 220 so that opening and closing the housing 220 displaces the C-shaped element in said plane perpendicular to the first direction (V). When the housing 220 is open, the engaging means 230 is retracted so that the liquid container 100 may be inserted or removed from the dispenser 200. When the housing 220 is closed, the engaging means 230 is deployed, and engages with the liquid container 100. Suitably, the engaging means 230 engages with the locking collar 130 of the liquid container 100. The locking collar 130 of the liquid container 100 may also include a pattern of cut-outs or protrusions which engages with the engaging means 230.

A number of moving parts of the dispenser 200/liquid container 100 are integral with the liquid container 100, or can be removed from the dispenser. As a result, if a dispenser 200 stops functioning, the entire dispenser 200 may not need to be replaced, but, instead, a new liquid container 100 with integral foam pump 110 may be placed in the dispenser 200 instead.

Example embodiments described above may be combined as understood by a person skilled in the art.

Therefore, it is to be understood that the foregoing is illustrative of various example embodiments and the invention is not to be limited to the specific embodiments disclosed, and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms:

"a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "on", "coupled" or "connected" to another element, it can be directly on, coupled or connected to the other element or intervening elements may also be present. In contrast, when an element is referred to as being "directly on", "directly coupled" or "directly connected" to another element, there are no intervening elements present.

It will be understood that although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section without departing from the teachings of the present invention.

Example embodiments of the present invention have been described herein with reference to cross-section illustrations that are schematic illustrations of idealized embodiments (and intermediate structures) of the invention. As such, variations from the shapes of the illustrations as a result, for example, of manufacturing techniques and/or tolerances are to be expected. Thus, embodiments of the present invention should not be construed as limited to the particular shapes of regions illustrated herein but are to include deviations in shape that result, for example, from manufacturing.

The invention claimed is:

1. A dispenser for a replaceable liquid container comprising a foam pump arranged to be activated in a first direction, the dispenser comprising:

a housing for containing the liquid container; and an actuator which is displaced directly by a user or displaced via a motor, wherein the actuator is adapted to displace a nozzle cap in the first direction so as to transfer a movement of the actuator to the foam pump, and wherein the nozzle cap is integral with the replaceable liquid container, is arranged to at least partly surround a compressible chamber portion of the foam pump in a decompressed position, and is arranged in sliding abutment with and externally to a connecting portion of the replaceable liquid container.

2. The dispenser according to claim 1, wherein the actuator is adapted to act directly on the nozzle cap.

3. The dispenser according to of claim 1, wherein the actuator is arranged to cooperate with a flange of the nozzle cap, wherein the flange extends at least partly in a direction perpendicular to the first direction.

4. The dispenser according to claim 1, wherein the actuator is an integral part of the dispenser.

5. The dispenser according to claim 1, wherein the actuator comprises lugs arranged to engage with the nozzle cap.

6. The dispenser according to claim 1, wherein the actuator is hinged to the dispenser about pivots.

7. The dispenser according to claim 1, wherein the dispenser comprises an engaging element for holding the liquid container in place in the dispenser.

8. The dispenser according to claim 7, wherein the engaging element comprises a C-shaped element, wherein the C-shaped element is displaceable in a plane substantially perpendicular to the first direction.

9. The dispenser according to claim 7, wherein the engaging element is adapted to engage the liquid container by closing the housing of the dispenser.

10. A liquid container for a dispenser comprising:

a liquid reservoir; and a foam pump, wherein activation of said foam pump in a first direction discharges a quantity of liquid in the form of a foam from said liquid reservoir via said foam pump, wherein a nozzle cap is arranged to at least partly enclose the foam pump during storage, transport and use of the liquid container, wherein the nozzle cap is arranged to at least partly surround a compressible chamber portion of the foam pump in a decompressed position, and is arranged in sliding abutment with and externally to a connecting portion of the replaceable liquid container, wherein the nozzle cap comprises a first end surface extending perpendicular to said first direction, wherein said nozzle cap is integral with the replaceable liquid container and is displaceable in the first direction so as to activate the foam pump in said first direction by an actuator, and wherein said first end surface of said nozzle cap comprises a dispensing opening aligned with the foam pump through which said quantity of said liquid in the form of a foam is discharged upon activation of said foam pump.

11. The liquid container according to claim 10, wherein said foam pump comprises at least one piston, at least one cylinder, and at least one air chamber, wherein said at least one piston is located within said at least one cylinder and is displaceable in a first direction within said cylinder, such that, upon activation of said foam pump, said at least one piston acts within said at least one cylinder so as to discharge a quantity of liquid from said liquid reservoir, and wherein said at least one air chamber is arranged such that activation of the foam pump compresses the air chamber so as to force air into the liquid in the foam pump, thus creating a foam.

12. The liquid container according to claim 10, wherein the nozzle cap comprises a flange extending at least partly in a direction perpendicular to said first direction.

13. The liquid container according to claim 12, wherein the flange is located at a second end of said nozzle cap in said first direction.

14. The liquid container according to claim 10, wherein the foam pump, the nozzle cap, and the dispensing opening in said first end surface of said nozzle cap each have an axis of symmetry in the first direction, said axes of symmetry coinciding in the first direction.

15. The liquid container according to claim 10, wherein the liquid container further comprises a locking collar, said locking collar being arranged such that, in a first state of said locking collar, the locking collar abuts the nozzle cap and prevents the displacement of said nozzle cap in said first direction, and, in a second state (B) of said locking collar, the nozzle cap can be displaced in said first direction.

16. The liquid container according to claim 15, wherein said locking collar is displaceable in the first direction between said first state (A) and said second state (B).

17. The liquid container according to claim 10, wherein the container comprises a portion provided with at least one protrusion and the nozzle cap is provided with at least one groove, and wherein the at least one protrusion engages in the at least one groove.

18. The liquid container according to claim 17, wherein the nozzle cap in a first position is fixed in the first direction by the protrusion engaging in the groove, and wherein the nozzle cap in a second position is movable in the first direction.

19. The liquid container according to claim 18, wherein the nozzle cap is arranged to be displaced between the first position and the second position by turning the nozzle cap in a direction substantially perpendicular to the first direction.

20. A device comprising:

a dispenser; and a replaceable liquid container, wherein said liquid container comprises a liquid reservoir and a foam pump arranged such that activation of said foam pump in a first direction discharges a quantity of liquid in the form of a foam from said liquid reservoir via said foam pump, wherein said dispenser comprises an actuator which is displaced directly by a user or displaced via a motor, wherein a lifting arrangement that includes a nozzle cap is displaceable in the first direction and is situated between said actuator and said foam pump, said lifting arrangement being arranged so as to transfer the movement of said actuator to said foam pump in said first direction, so as to activate the foam pump, wherein said lifting arrangement is integral with the replaceable liquid container or is removable from the dispenser, the lifting arrangement having an engaging surface that at least partially surrounds the foam pump; and wherein the nozzle cap is integral with the replaceable liquid container, is arranged to at least partly surround a compressible chamber portion of the foam pump in a decompressed position, and is arranged in sliding abutment with and externally to a connecting portion of the replaceable liquid container.

21. The device according to claim 20, wherein said lifting arrangement is integral with the replaceable liquid container.

22. The device according to claim 20, wherein the nozzle cap comprises a first end surface extending perpendicular to said first direction, said first end surface comprising a dispensing opening aligned with the foam pump to allow discharge of a quantity of said liquid through said dispensing opening.

23. The device according to claim 20, wherein the nozzle cap comprises a flange extending at least partly in a direction perpendicular to said first direction, said flange being arranged to cooperate with said actuator of said dispenser.

24. The device according to claim 20, wherein the liquid container further comprises a locking collar, said locking collar being arranged such that, in a first state (A) of said locking collar, the locking collar abuts the nozzle cap and prevents the displacement of said nozzle cap in said first direction, and, in a second state (B) of said locking collar, the nozzle cap can be displaced in said first direction.

25. The device according to claim 24, wherein said locking collar is displaceable in the first direction between said first state (A) and said second state (B).

26. The device according to claim 20, wherein said actuator is an integral part of the dispenser.

27. The device according to claim 20, wherein said actuator is adapted to act directly on the lifting arrangement.

28. The device according to claim 20, wherein said actuator comprises lugs arranged to engage with the lifting arrangement.

29. The device according to claim 20, wherein said actuator is hinged to the dispenser about pivots.

30. The device according to claim 20, wherein the dispenser comprises an engaging element for holding the liquid container in place in the dispenser.

31. The device according to claim 30, wherein the engaging element comprises a C-shaped element, wherein the C-shaped element is displaceable in a plane substantially perpendicular to the first direction.

32. The device according to claim 20, wherein said dispenser comprises a housing for containing the liquid container.

33. The device according to claim 30, wherein said dispenser comprises a housing for containing the liquid container, and wherein the engaging element is adapted to engage the liquid container by closing the housing of the dispenser.

34. The device according to claim 20 activation of said foam pump in a first direction discharges a quantity of liquid in the form of a foam from said liquid reservoir via said foam pump, wherein the nozzle cap is arranged to at least partly enclose the foam pump during storage, transport and use of the liquid container, wherein the nozzle cap comprises a first end surface extending perpendicular to said first direction, wherein said nozzle cap is integral with the replaceable liquid container and is displaceable in the first direction so as to activate the foam pump in said first direction, and wherein said first end surface of said nozzle cap comprises a dispensing opening aligned with the foam pump through which said quantity of said liquid in the form of a foam is discharged upon activation of said foam pump.

35. The dispenser according to claim 1, wherein the actuator has an engaging surface that partially surrounds the foam pump.

36. The dispenser according to claim 1, wherein the nozzle cap is arranged to fully surround the compressible chamber of the foam pump when in a compressed position.

37. The dispenser according to claim 1, wherein the nozzle cap includes an engagement flange that engages with the actuator, and is configured to be pushed by the actuator in the first direction so that the engagement flange is located between the liquid reservoir and the compressible chamber in a compressed position.

38. The liquid container according to claim 10, wherein the nozzle cap is arranged to fully surround the compressible chamber of the foam pump when in a compressed position.

39. The liquid container according to claim 10, wherein the nozzle cap includes an engagement flange that engages with the actuator, and is configured to be pushed by the actuator in the first direction so that the engagement flange is located between the liquid reservoir and the compressible chamber in a compressed position.

40. The device according to claim 20, wherein the nozzle cap is arranged to fully surround the compressible chamber of the foam pump when in a compressed position.

41. The device according to claim 20, wherein the nozzle cap includes an engagement flange that engages with the actuator, and is configured to be pushed by the actuator in the first direction so that the engagement flange is located between the liquid reservoir and the compressible chamber in a compressed position.

* * * * *